US007118841B2

(12) United States Patent
Iga

(10) Patent No.: US 7,118,841 B2
(45) Date of Patent: Oct. 10, 2006

(54) TONER FOR DEVELOPING AN ELECTROSTATIC IMAGE

(75) Inventor: Takashi Iga, Tokyo (JP)

(73) Assignee: Zeon Corporation, Tokyo (JP)

( * ) Notice: Subject to any disclaimer, the term of this patent is extended or adjusted under 35 U.S.C. 154(b) by 0 days.

(21) Appl. No.: 10/425,888

(22) Filed: Apr. 30, 2003

(65) Prior Publication Data

US 2003/0203301 A1 Oct. 30, 2003

(30) Foreign Application Priority Data

Apr. 30, 2002 (JP) ..... 2002-128020

(51) Int. Cl.
*G03G 9/087* (2006.01)
*G03G 9/093* (2006.01)

(52) U.S. Cl. ..... 430/109.2; 430/110.2; 430/109.4

(58) Field of Classification Search ..... 430/109.1, 430/109.2, 109.4, 110.2
See application file for complete search history.

(56) References Cited

U.S. PATENT DOCUMENTS 2,297,691 A * 10/1942 Carlson ..... 430/55
3,968,278 A * 7/1976 Wells ..... 427/258
4,508,806 A * 4/1985 Oseto et al. ..... 430/109.2
4,968,575 A * 11/1990 Matsumura et al. ..... 430/109.4
5,973,054 A * 10/1999 Kushino et al. ..... 524/457
6,132,916 A * 10/2000 Ueda et al. ..... 430/109.3

FOREIGN PATENT DOCUMENTS

| | | |
|---|---|---|
| JP | 7-199522 | 8/1995 |
| JP | 8-30909 | 3/1996 |
| JP | 10-307419 | 11/1998 |
| JP | 11-72951 | 3/1999 |

OTHER PUBLICATIONS

Diamond, Arthur S. (ed.) Handbook of Imaging Materials. New York: Marcel-Dekker, Inc. (1991) pp. 168, 169, 196.*

* cited by examiner

*Primary Examiner*—Christopher RoDee
(74) *Attorney, Agent, or Firm*—Armstrong, Kratz, Quintos, Hanson & Brooks, LLP

(57) ABSTRACT

The present invention is to provide a toner for developing an electrostatic image, having good fixing property and shelf stability, as well as having a good transferring property without decreasing its printing concentration nor generating a fog, even where it is subjected to a printing condition exposed under various circumstances and for an extended period. The toner of the present invention comprises a colored particle including a rosin ester having an acid value of 2 or less; and an external additive. The rosin ester used in the present invention is an electrification compound of a rosin compound with a polyalcohol. The electrification compound of the rosin ester may be reacted with an epoxy compound. The colored particle has a core-shell structure. The colored particle further comprises a binder resin, a colorant, a charge control agent, a parting agent in the core, and a magnetic material in the core.

17 Claims, No Drawings

TONER FOR DEVELOPING AN ELECTROSTATIC IMAGE

FIELD OF THE INVENTION

The present invention relates to a toner for developing an electrostatic image, that is used for developing a latent image formed, for example, by electrophotography method, electrostatic recording method and so on, and in particular, the present invention relates to a toner having good fixing property and shelf stability, as well as good transferring property as confirmed by a repeated print test of the toner, without decreasing or fading a printing density nor generating fog, as running.

RELATED ART

In an image forming device such as electrophotography device and electrostatic recording device, a latent image of electrostatics is formed on a photosensitive member, which is developed by a toner. Then, the image formed or developed by the toner is transferred on a transfer medium such as paper, followed by being fixed by means of heating, pressuring, solvent-steaming and so on.

Several steps are carried out in such an image forming device, and among them, the step of fixing the toner consumes the most energy, in which a heat-pressure fixing principle is used in view of energy efficiency.

Recently, an image forming device, with a lower operating cost and increased processing speed, has been demanded. In order to accomplish such demands imposed on such an image forming device, it is also necessary to improve the toner. As a toner used in such a fixing principle, it is preferably proposed to use the one capable to be fixed at a comparatively low temperature.

Japanese examined patent publication No. 8-30,909 discloses a toner for developing an electrostatic image comprising: a mixture of a resin having an acid value of 13 or less, and a resin having an acid value of 30 or more, with each of the resins having a specific peak in its molecular weight; and a colorant dispersed therein. Japanese laid open patent publication No. 7-199,522 discloses a toner composition for electrophotography having: a core material including a rosin ester, and an outer shell layer of polyurea resin and polyurethane resin. When an image is, however, formed at a high speed by using these toners of the related art, the fixing is difficult, especially, at a low temperature.

On the other hand, Japanese laid open patent publication No. 10-307,419 discloses a toner for electrophotography including a rosin ester having a softening point of 70 to 120° C., and Japanese laid open patent publication No. 11-72,951 discloses a toner for heat-pressure fixing, comprising: a core material of heat-meltability including a rosin ester, and an outer shell layer of non-crystalline polyester or hybrid resin, provided on the surface of the core material. It should be noted that these publications do not describe any rosin esters having an acid value of 2 or less, nor any suggestions as to specification or modification disclosed in the present invention.

The inventors of the present invention, however, have researched those toners of the related art, and the inventors have eventually found that such toners may be satisfied with the operation of printing at a high speed and at a low fixing temperature, but they may lack in circumstance stabilization. In other words, if such toners are subjected to a lasting print test, as exposed under various circumstances for an extended period, the printing density is decreased or faded and a fog is generated.

Therefore, the objective of the present invention is to provide a toner for developing an electrostatic image, having good fixing property and shelf stability, as well as having a good transferring property without decreasing or fading its printing density nor generating a fog, even where it is subjected to a printing condition such as exposed under various circumstances and for an extended period.

The inventors of the present invention have performed various research to accomplish the objective, and finally found that a rosin compound derivative having a specified acid value is effective to include, so as to give a novel toner having the stated objectives.

According to the present invention, there is provided a toner for developing an electrostatic image, comprising a rosin derivative having an acid value of 2 or less.

DETAILED EXPLANATION OF THE INVENTION

The present invention is described below in detail

The toner for developing an electrostatic image of the present invention comprises a colored particle and an external additive.

The colored particle comprises a binder resin, a colorant, a charge control agent, and a rosin ester having an acid value of 2 or less, and may include, if necessary, a parting agent, a magnetic material and so on.

The binder resin may include a resin which have been conventionally used in a toner, exemplified as polystyrene, styrene and butylacrylic acid copolymer, polyester resin, epoxy resin, and cyclic isoprene rubber.

The colorant may include carbon black, titanium black, magnetic powder, oil black and titanium white, and any pigments and/or dyes other than those as mentioned here. Carbon black, coloring in black, is preferable especially if it has the primary particle size of 20 to 40 nm. When carbon black has the primary particle size within the range as mentioned here, it may be dispersed homogeneously in the toner, resulting in avoiding generation of a fog.

The colorant is generally included in an amount of 1 to 10 parts by weight, per 100 parts by weight of the binder resin.

A charge control agent, which has been used in a conventional toner may be used. For example, the charge control agent may include BONTRON N-01 (by Orient Chemical Industries Ltd.), NIGROSIN BASE EX(by Orient Chemical Industries Ltd.), SPIRON BLACK TRH(by Hodogaya Chemical Co., Ltd), T-77 (by Hodogaya Chemical Co., Ltd), BONTRON S-34 (by Orient Chemical Industries Ltd.), BONTRON E-81 (by Orient Chemical Industries Ltd.), BONTRON E-84 (by Orient Chemical Industries Ltd.), COPY CHARGE NX(by Clariant Corporation), COPY CHARGE NEG(by Clariant Corporation) and the like. In addition, quaternary ammonium (salt) group containing copolymers, as disclosed in Japanese laid open patent publications Nos. 63-60,458; 3-175,456; 3-243,954, and 11-15,192, and sulfonic acid (salt) group containing copolymers, as disclosed in Japanese laid open patent publications Nos. 1-217,464 and 3-15,858 may be used as the charge control agent, which are hereinafter especially referred to as charge control resin.

Among the charge control agents as mentioned above, it is preferable to use a charge control resin. The charge control resin has a high compatibility with the binder resin, and it is achromatic, so that it may provide a toner having electrostatic stability even if it is subjected to a condition to print at a high speed for an extended time.

The charge control resin preferably has a glass transition temperature of 40 to 80° C., and more preferably of 45 to 75° C., and further more preferably of 45 to 70° C. Where the charge control resin has a glass transition temperature within the range as mentioned here, it is possible to improve the balance of shelf stability and fixing property of the toner of the present invention.

The charge control agent is preferably included in an amount of 0.01 to 20 parts by weight, and more preferably in an amount of 0.1 to 10 parts by weight, per 100 parts by weight of the binder resin.

According to the present invention, the rosin ester is obtained by electrification of an alcohol with a rosin compound including gum rosin, wood rosin and tall oil rosin, and denaturations thereof by subjecting to reaction such as disproportion, hydrogenation, partial fumarization, partial maleinization and polymerization. The alcohol used in the electrification is preferably exemplified by a polyalcohol such as pentaerythritol, glycerin and diethyleneglycol.

According to the present invention, the rosin ester has an acid value of 2 or less, but it is especially preferable to use a rosin ester having an acid value of 1 or less. Such a rosin ester as having a smaller acid value is exemplified by the one obtained by reacting a polyalcohol ester of a rosin compound with an epoxy compound.

The epoxy compound useful in the above reaction may include a bisphenol A epoxy resin such as EPOTOHTO YD-128 (by Tohto Kasei Co., Ltd.), a bisphenol F epoxy resin such as EPOTOHTO YDF-170 (by Tohto Kasei Co., Ltd.), phenol novolak epoxy resin such as EPOTOHTO YDPN-638 (by Tohto Kasei Co., Ltd.); an alcohol glycidyl ether epoxy resin such as EPOTOHTO PP-101 (by Tohto Kasel Co., Ltd.), EPOTOHTO PG-202 (by Tohto Kasei Co., Ltd), EPIOL EH (by NFO Corporation), EPIOL L-41 (by NFO Corporation), EPIOL SK (by NFO Corporation) and so on. Among those as mentioned here, an alcohol glycidyl ether epoxy resin is preferably used since it has a high reactivity with a remaining acid and it hardly affects adversely the softening point of the rosin ester used in the present invention.

The rosin ester used in the present invention has a softening point of 60 to 120° C., and preferably of 70 to 110° C. The rosin ester having a softening point within the range as mentioned here is preferably used since it may provide a toner having both the fixing property and shelf stability.

The rosin ester is preferably included in an amount of 5 to 50 parts by weight, and more preferably in an amount of 10 to 40 parts by weight, per 100 parts by weight of the binder resin. Where the colored particle used in the present invention is of a core-shell structure as described hereinafter, the rosin ester is preferably included in the core layer of the core-shell structure.

The parting agent may include polyolefin waxes such as low molecular weight polyethylene, low molecular weight polypropylene and low molecular weight polybutylene; natural plant waxes such as candelilla, carnauba wax, rice, wood wax, jojoba oil; petroleum waxes such as paraffin, microcrystalline wax and petrolactam, and denaturations thereof; synthesized waxes such as Fischer Tropsch wax and so on; and multifunctional ester compounds such as pentaerythritol tetramyristate, pentaerythritol tetrapalmitate, and dipentaerythritol hexamyristate. These compounds exemplified as the parting agent may be used alone or in combination.

Among these as listed here, it is preferable to use the synthesized waxes, polyolefin waxes, especially denaturing the ends thereof, petroleum waxes, and multifunctional ester compounds. Among the multifunctional ester compounds, it is preferable to use pentaerythritol esters, in which a DSC curve, measured by means of differential scanning calorimeter, shows an endothermic peak, at raising the temperature from 30 to 200° C., and more preferably from 40 to 160° C., and further preferably from 50 to 120° C. and dipentaerythritol esters having a DSC curve of an endothermic peak, at raising the temperature, from 50 to 80° C. The reason to favorably use pentaerythritol esters and/or dipentaerythritol esters is that such compounds may provide an excellent toner having a balance in fixing and offset properties. Among the multifunctional ester compounds such as the pentaerythritol esters having an endothermic peak, at raising the temperature, from 30 to 200° C. and dipentaerythritol esters having an endothermic peak, at raising the temperature, from 50 to 80° C., it is preferable to use the one having a molecular weight of 1,000 and more, where the multifunctional ester compound may be dissolved in an amount of 5 parts by weight or more into 100 parts by weight of styrene, at a temperature of 25° C., and where the multifunctional ester compound has an acid value of 10 mg/KOH or less. Such multifunctional ester compound may significantly contribute to decrease the fixing temperature. The endothermic peak may be measured according to ASTM D3418-82.

The parting agent may be included in an amount of 0.5 to 50 parts by weight, and preferably in an amount of 1 to 20 parts by weight, per 100 parts by weight of the binder resin.

The magnetic material used in the present invention may include iron oxides such as magnetite, γ-ferric oxide, ferrite, and iron excess ferrite, metals such as iron, cobalt and nickel, alloys of the metals and at least one metal selected from the group of aluminum, copper, lead, magnesium, tin, zinc, antimony, beryllium, bismuth, cadmium, calcium, manganese, selenium, titanium, tungsten and vanadium, and mixture thereof.

The colored particle of the present invention may comprise a structure of, so-called, a core-shell type or capsule type, that comprises a core of a first polymer and an outer shell layer of a second polymer covering the core. The first polymer of the core is different from the second polymer of the outer shell. The reason to favorably use a core-shell type is that the core has a softening point lower than that of the shell layer, and that the core is covered with the shell layer, such that the fixing temperature is decreased, accompanied with preventing the toner from aggregating during preservation.

In the core-shell type particle of the present invention, the weight ratio between the core and the outer shell layer is not limited, but it is preferably to be at a weight ratio of 80/20 to 99.9/0.1.

The outer shell layer having the ratio as mentioned here may provide a toner of the present invention with good shelf stability and fixing property.

The outer shell layer of the particle of the core-shell structure may have an average thickness of 0.001 to 1.0 μm, and preferably of 0.003 to 0.5 μm, and more preferably of 0.005 to 0.2 μm. If the outer shell layer has too much thickness, the toner may decrease its fixing property, and on the other hand, if the outer shell layer has too small thickness, the toner may decrease its shelf stability. All of the surface of the core is not necessarily to be covered with the outer shell layer, and it may be sufficient to cover at least a part of the core surface with the outer shell layer.

The colored particle of the present invention may have a volume average particle size (dv) of 2 to 20 μm, and preferably of 3 to 12 μm, and more preferably of 4 to 10 μm. If the colored particle has too small particle size, it may decrease flowability, resulting in decreasing the transferring property, generating thin spots, or decreasing the printing density, as running. If the colored particle, on the other hand, has too large particle size, it may cause the generation of fog or scatter toner so as to adversely affect the resolution of the image.

It is preferable that the colored particle of the present invention may have a particle size distribution (dv/dp), that is the ratio between the volume average particle size (dv) and number average particle size (dp), of 1.0 to 1.3, and preferably of 1.0 to 1.2. Too broad particle size distribution may cause the generation of thin spots and the decrease of transferring property, the decrease of printing density and the degradation of resolution property.

The preferable ranges in the volume average particle size and particle size distribution as described above may be enabled, for example, by classification.

The volume average particle size and the particle size distribution of the colored particle may be measured, for example, by means of MULTISIZER (manufactured by Beckman Coulter Co.).

The colored particle of the present invention may have an average sphericity of 1 to 1.3, and preferably of 1.0 to 1.2, and more preferably of 1.0 to 1.05, wherein the average sphericity is obtained as follows: The absolute longest length of the colored particle is defined as a diameter, followed by calculating an area (Sc) of a circle having the diameter, and then, the area (Sc) is divided by a real projected area (Sr) of the particle so as to obtain the average sphericity. If exceeding the average sphericity of 1.3 in the present invention, it may cause the decrease of the transferring property of the toner.

The preferable range of the average sphericity as mentioned here may be obtained, for example, by means of phase inversion emulsification method, dissolution suspension method and polymerization method.

The average sphericity is obtained as follows: An electron microscopic picture of the colored particle is taken, followed by measuring and analyzing it by means of an image analyzing device, such as LUZEX IID (manufactured by Nireko K.K.). With respect to the frame area, the area ratio of the particle is defined as maximum 2%. Total number of the processed particles is defined as 100 particles. The sphericities of the obtained 100 particles are averaged to obtain the sphericity.

The colored particle of the present invention may be prepared, but not be limited thereto, by means of milling method, phase inversion emulsification method, and polymerization method. The colored particle prepared by means of polymerization method may be thereafter aggregated. Among these methods as mentioned here, it is preferable to use the colored particle, which is prepared by means of polymerization method. The colored particle prepared by polymerization method may be formed into a substantial spherical shape, so that the rosin ester may be homogeneously dispersed therein so as to accomplish good transferring property and fixing properties, resulting in obtaining a toner having an improvement of image resolution, being capable of the speeding up of the print.

Next, the preparation method of the colored particle will be described in detail with respect to polymerization.

An aqueous dispersion medium including a dispersion stabilizer is prepared, into which a polymerizable monomer composition including a polymerizatable monomer, a colorant, a charge control agent and a rosin ester is dispersed. Then, a polymerization initiator is added to raise it into a specified temperature to carry out polymerization, followed by being washed, dewatered and dried to obtain the colored particle.

The polymerizable monomer for preparing the binder resin may include a monovinyl monomer, a cross-linkagable monomer, a macro monomer and so on. Such polymerizable monomer becomes the binder resin when it is polymerized.

The monovinyl monomer may include aromatic vinyl monomers such as styrene, vinyl toluene, and α-methyl styrene; (meth)acrylic acid; (meth)acrylic acid derivatives such as (meth)acrylic acid methyl, (meth)acrylic acid ethyl, (meth)acrylic acid propyl, (meth)acrylic acid butyl, (meth) acrylic acid 2-etylhexyl, (meth)acrylic acid cyclohexyl, (meth)acrylic acid isobonyl, (meth)acrylic acid dimethylaminoethyl, and (meth)acrylamide, mono olefin monomers such as ethylene, propylene and butylenes.

The monovinyl monomer may be used alone or in combination. Among the monovinyl monomer as mentioned above, it is preferable to use aromatic vinyl monomers alone, or to use aromatic vinyl monomers in combination with (meth)acrylic acid derivatives.

Together with the monovinyl monomer, the using of a cross-linkagable monomer and a cross-linkagable polymer may efficiently improve a hot offset property. The cross-linkagable monomer and cross-linkagable polymer, respectively, may be used alone or in combination. They are used in a total amount of 10 parts by weight or less, and preferably in an amount of 0.1 to 2 parts by weight, per 100 parts by weight of the monovinyl monomer.

Also, together with the monovinyl monomer, additional use of a macro monomer is preferable to balance the shelf stability and the lowing of the fixing temperature. It is preferable to select a macro monomer to produce a polymer having a glass transition temperature higher than that of a polymerized material of the monovinyl monomer. Such macro monomer may preferably be hydrophilic. In particular, such macro monomer may preferably be a homopolymer of methacrylic acid ester or acrylic acid ester, and a copolymer thereof. The macro monomer may be used in an amount of 0.01 to 10 parts by weight, and preferably in an amount of 0.03 to 5 parts by weight, and more preferably in an amount of 0.05 to 1 parts by weight, per 100 parts by weight of the monovinyl monomer used. The using of the macro monomer in the above mentioned range is preferable since the shelf stability of the toner is improved while keeping a good fixing property.

The dispersion stabilizer may include metallic compounds exemplified by sulfates such as barium sulfate, and calcium sulfate; carbonates such as barium carbonate, calcium carbonate, and magnesium carbonate; phosphates such as calcium phosphate; metal oxides such as aluminum oxide and titanium oxide; and metallic hydroxides such as aluminum hydroxide, magnesium hydroxide, and ferric hydroxide; as well as water-soluble polymers such as polyvinyl alcohol, methyl cellulose, and gelatin; anionic surface active agents, nonionic surface active agents, and amphoteric surface active agents. The dispersion stabilizers as mentioned here may be used alone or in combination.

Among the dispersion stabilizer as listed here, the metallic compounds, especially which includes a colloid of hardly water-soluble metallic hydroxide, is preferably used as the dispersion stabilizer, since it may narrow the particle size distribution of the obtained polymer particles, and since such dispersion stabilizer hardly remains after washing, resulting in contributing to the sharpness of the developed image.

With respect to the particle size distribution of the colloid of hardly water-soluble metallic hydroxide, it may have, when being measured from the smaller particle size, a 50% cumulative value of number particle size distribution (Dp50) of 0.5 μm or less, and a 90% cumulative value of number particle size distribution (Dp90) of 1 μm or less. If the particle size of the colloid is larger than that as mentioned above, it may be difficult to stably carry out polymerization, and also, the obtained toner may be degraded in its shelf stability.

The dispersion stabilizer may be used in an amount of 0.1 to 20 parts by weight per 100 parts by weight of the polymerizable monomer. When the dispersion stabilizer is used in the amount as mentioned here, the monomer may be polymerized stably while preventing the aggregation of the polymer, resulting in obtaining a toner having a specified particle size.

The polymerization initiator may include persulfates such as potassium persulfate and ammonium persulfate; azo compounds such as 4,4'-azobis (4-cyano valeric acid), 2,2'-azobis (2-methyl-N-(2-hydroxyethyl) propionamido), 2,2'-azobis (2-amidi isobutyronitrile; peroxides such as di-t-butyl peroxide, dicumyl peroxide, lauroyl peroxide, benzoyl peroxide, t-butylperoxy-2-ethylhexaenoate, t-hexylperoxy-2-ethylhexaenoate, t-butylperoxypivalate, di-isopropylperoxy dicarbonate, di-t-butylperoxy isophthalate, 1,1,3,3-tetramethylbutylperoxy-2-ethylhexaenoate, and t-butylperoxy-isobutylate. In addition, the polymerization initiator as described above may be used in combination with a reducing agent, so as to be used as a redox initiator.

Among the polymerization initiators as mentioned above, it is preferable to use an oil-soluble initiator, which may be dissolved into the polymerizable monomer used in the present invention, and if necessary, it may be used in combination with a water-soluble polymerization initiator. The polymerization initiator may be used in an amount of 0.1 to 20 parts by weight, and preferably in an amount of 0.3 to 15 parts by weight, and further preferably in an amount of 0.5 to 10 parts by weight, per 100 parts by weight of the polymerizable monomer used.

Also, it is preferable to use a molecular weight modifier in carrying out the step of polymerization. The molecular weight modifier may include mercaptans such as t-dodecyl mercaptan, n-dodecyl mercaptan, n-octyl mercaptan, and halogenated hydrocarbons such as carbon tetrachloride and carbon tetrabromide. The molecular weight modifier may be added before initiating polymerization, or in the middle of polymerization. The molecular weight modifier may be used in an amount of 0.01 to 10 parts by weight, and preferably in an amount of 0.1 to 5 parts by weight, per 100 parts by weight of the polymerizable monomer used in the present invention.

The colored particle of the core-shell structure, which is preferably used as the colored particle of the present invention, may be prepared, for example, by means of spray dry method, interfacial reaction method, in-situ polymerization method, phase separation method, and so on. To be more precise, a core particle is prepared by means of milling method, polymerization method, aggregation method, and phase inversion method, and then, it is covered with an outer shell layer, so as to obtain a colored particle of core-shell structure. Among several methods as mentioned here, it is preferable to use in-situ polymerization method or phase separation method in view of production efficiency.

Next, the detail preparation method of a colored particle of core-shell structure is described with respect to in-situ polymerization method.

Core particles are dispersed in an aqueous dispersion medium, into which a polymerizable monomer for the shell and a polymerization initiator are added to initiate polymerization to obtain a colored particle of core-shell structure.

To be more precise, the polymerizable monomer for the shell may be continuously added and continued polymerization in the same reaction system for previously obtaining the core particle, and on the other hand, the polymerizable monomer for the shell may be added and polymerized in the reaction system different from that used in preparing the core particle.

The polymerizable monomer for the shell may include styrene, acrylonitrile, and methyl methacrylate, such that a polymer having a glass transition temperature more than 80° C. is obtained. The polymerizable monomer for the shell may be used alone or in combination.

At the time of adding the polymerizable monomer for the shell, it is preferable to add a water-soluble polymerization initiator, since it promotes to form a preferable colored particle of core-shell structure. When the water-soluble polymerization initiator is added at the time of adding the polymerizable monomer for the shell, the water-soluble polymerization initiator may enter into the vicinity of the outer surface of the core particle where the polymerizable monomer migrates, resulting in promoting the formation of a shell of the polymer on the surface of the core particle.

The water-soluble polymerization initiator may include persulfates such as potassium persulfate and ammonium persulfate; and azo compounds such as 2,2'-azobis (2-methyl-N-(2-hydroxyethyl) propionamido), and 2,2'-azobis (2-methyl-N-(1,1-bis(hydroxymethyl)ethyl) propionamido). The water-soluble polymerization initiator may be used in an amount of 0.1 to 50 parts by weight, and preferably in an amount of 1 to 30 parts by weight, per 100 parts by weight of the polymerizable monomer for the shell used in the present invention.

The external additive may include an inorganic particle, an organic resin particle and so on. The external additive has an average particle size smaller than that of the toner. For example, the inorganic particle may include silicon dioxide, aluminum oxide, titanium oxide, zinc oxide, tin oxide, barium titanate, and strontium titanate. The organic resin particle may include a polymer particle of methacrylic acid ester, a polymer particle of acrylic acid ester, a copolymer particle of styrene and methacrylic acid ester, a copolymer of styrene and acrylic acid ester, and a core-shell type particle having a core of styrene polymer and a shell of methacrylic acid ester polymer. Among these as mentioned here, it is preferable to use a silicon dioxide particle and a titanium oxide particle, and in particular, it is preferable to use the one whose surface is subject to a hydrophobic treatment. In particular, it is preferable to use a silicon dioxide particle subjected to a hydrophobic treatment. The amount of the external additive is not limited, but the external additive may be used in an amount of 0.1 to 6 parts by weight per 100 parts of the toner of the present invention.

The toner of the present invention may be prepared by mixing the colored particle with the external additive by means of a blending machine, such as Henschel Mixer, such that the external additive is attached to or combined with the surface of the colored particle, or partially introduced into in the colored particle.

The toner according to the present invention may have a volume resistivity of 10 to 13 (log(Ω·cm)), and more preferably of 10.5 to 12.5 (log(Ω·cm)), which is measured by a dielectric loss measuring instrument. When the toner of the present invention has a volume resistivity less than the range as mentioned here, it may cause the generation of a fog, and when the toner has a volume resistivity larger than the range as mentioned here, it may cause the scattering of toner, the generation of fog, and the deterioration in filming and cleaning.

EXAMPLES

The present invention will be described in detail based on the examples according to the present invention and the comparative examples outside the scope of the present invention. However, the present invention should not be construed to be limited into the examples. Unless noted otherwise, "parts" and "%" in the explanation of the following examples are based on the weight.

The examples and comparative examples are evaluated by the following methods.

1. The Property of the Colored Particle (1) Volume Average Particle Size and Particle Size Distribution With respect to the colored particle, a volume average particle size (dv), and a diameter size distribution, that is a ratio (dv/dp) of volume average particle size (dv) and number average particle size (dp), were measured by means of MULTISIZER (manufactured by Beckman Coulter Inc.). The measurement by MULTISIZER was carried out under the following conditions: The aperture diameter was set as 100 μm, and Isotone II was used as a medium, and the concentration was set at 10%, and the number of particles subjected to measurement was 100,000 particles.

2. The Property of Toner (1) Volume Resistivity

About 3 g of toner was put into a tablet forming apparatus, for forming a tablet having a diameter of 5 cm, followed by subjecting the toner to a load of 100 kg, approximately, for a period of 1 minute, to obtain a sample. Using a dielectric loss measuring instrument, "TRS-10 MODEL" of Ando Electric Co Ltd., a volume resistivity of the sample was measured under the condition at a frequency of 1 kHz and at a temperature of 30° C.

(2) Flowability

A set of three kinds of sieves is prepared, in which the set of sieves comprises a first sieve having a sieve opening of 150 μm cumulated on a second sieve having a sieve opening of 75 μn, which is further cumulated on a third sieve having a sieve opening of 45 μm. About 4 g of toner was precisely weighted before it was put on the set of sieves. Then, the set of sieves was vibrated by using a powder measuring instrument ("POWDER TESTER " by Hosokawa Micron Corporation), under the condition of setting its vibration strength scale at 4, for a period of 15 seconds, and then, the amounts of the toner remaining on the respective sieves were weighted. From the obtained weights, the following formulas (1), (2) and (3) were used to calculate the flowability. With respect to one sample, measurement was repeated in triplicate, and the data were averaged.

Formulas:

"*a*"=[(the weight of the toner remaining on the sieve having a sieve opening of 150 μm (g))/(the weight of the toner used, which is precisely weighted beforehand (g))]×100 (1)

"*b*"=[(the weight of the toner remaining on the sieve having a sieve opening of 75 μm (g))/(the weight of the toner used, which is precisely weighted beforehand (g))]×100×0.6 (2)

"*c*"=[(the weight of the toner remaining on the sieve having a sieve opening of 45 μm (g))/(the weight of the toner used, which is precisely weighted beforehand (g))]×100×0.2; and (3)

"Flowability"(%)=100−(*a*+*b*+*c*).

(3) Shelf Stability

A sample of toner was put into a housing capable of sealing. After sealing it, the housing was submerged into a homoiothermic water bath kept at a temperature of 55° C. for 24 hours before the housing was taken off Then, the sample of toner was put on a sieve of 42 mesh such that the aggregation structure of the sample formed in the housing was not broken. The powder measuring instrument as described above was set at the vibration strength of 4.5, and the sieve was vibrated for 30 seconds, and then, the toner remaining on the sieve was weighted to obtain a weight of aggregated toner. From the weight of aggregated toner and the weight of the sample used, calculation was made to obtain a shelf stability value (%) of the toner. The lower the value is, the more the shelf stability is improved.

3. Evaluation of Image Quality (1) Fixing Temperature

A commercially available printer of nonmagnetic one-component development principle (a machine for 16 sheets) was reconstructed such that the temperature at the fixing roll portion may be variously changed. At each 5° C. during changing the temperature at the fixing roll, a fixing test was carried out to research the relationship between fixing property and temperature therefor, and to calculate a fixing rate.

In order to stabilize the temperature at the fixing roll portion when changing it, the reconstructed printer was left as it is at least for 5 minutes. Then, a solid printing was made on a printing paper by using the reconstructed printer. With respect to the solid printed region of the printing paper, an adhesive tape was attached and then removed, before and after that a printing density was measured. The fix rate was calculated from the ratio of the printing densities before and after the operation of removing the adhesive tape. In detail, provided that the density of the image before removing the adhesive tape is referred to as "before ID," and the concentration of the image after removing it is referred to as "after ID," the fix rate is calculated as follows:

"Fixing Rate"(%)=(after ID)/(before ID)×100.

In the fixing test, the operation of removing the adhesive tape comprises the steps of attaching an adhesive tape on a portion to be measured on the printing paper, pressuring the adhesive tape under a specified load to firmly attach the adhesive tape on the portion to be measured; and removing the adhesive tape in the direction along with the printing paper at a specified speed.

In the fix test, the temperature of the fixing roll portion was determined to measure as a fixing temperature of the toner, at the temperature where its fix rate was 80%.

(2) Circumstance Stability Property

The reconstructed printer as described above was used in this test. This test was carried out under an H/H circumstance at a temperature of 35° C. and at a humidity of 80%; and under an L/L circumstance at a temperature of 10° C. and at a humidity of 20%.

The test was started to continue printing at a concentration of 5%, which was interrupted, once every 1000 sheets of paper, by printing at a concentration of 100%, that is, a solid printing, and by printing at a concentration of 0%, that is, a white printing.

The printing at a concentration of 100%, that is, a solid printing, was intended to evaluate a printed concentration. The standard as to the printing concentration, when being measured by a Macbeth reflection densitometer, was defined to 1.3 or more in the present invention.

The printing at a concentration of 0%, that is, a white printing, was intended to evaluate the generation of a fog. During the printing at a concentration of 0%, the printing was paused right after being developed on the photosensitive member, followed by attaching an adhesive tape (Scotch Mending Tape 810-3-18, a product of Sumitomo 3M Limited) on the photosensitive member of the reconstructed printer. Thereafter, the adhesive tape was pealed to attach it on a new sheet of paper for measuring whiteness, that is, "whiteness (B)," using a whiteness meter (manufactured by Nippon Denshoku Industries Co., Ltd.). As a control, an adhesive tape alone was attached on another new sheet of paper to measure whiteness, that is "whiteness (B)." The difference between "whiteness (A)" and "whiteness (B)" was calculated to obtain a fog. The standard as to the fog value was defined to be 1 or less in the present invention. Alternatively, the generation of a fog may be evaluated by a fog as a standard, and in such a case, the standard of the fog may be defined to be 15% or less.

The number of the sheets of paper possible to continuously print was counted to evaluate the circumstance stability property of the toner. The printing was continued, so long as the resultant printed sheet of paper was satisfied with the standards as to the printing concentration and the fog. The printing was stopped when counting 10,000 sheets. In Table 1, the indication of ">10,000" means to satisfy with the standards, even at the time of printing 10,000 sheets of paper.

(3) Durability

Using the reconstructed printer, a durability of an image was researched under an N/N circumstance at a temperature of 23° C. and a humidity of 50%, whose method of the research was similar to that used in the test for circumstance stability property as described above. The number of the sheets printed at the time of finishing the print was 20,000. In Table 1, the indication of ">20,000" means that the printing density was 1.3 or higher and the fog were 15% or less, even at the time of printing 20,000 sheets of paper.

Synthesize Example 1

Into 100 parts of hydrogenerated rosin glycerin ester, having an acid value of 4.8 and a softening point of 101° C. ("PINECRYSTAL KE-100" by Arakawa Chemical Industries Co., Ltd.), 2.2 parts of alcohol glycidyl ether epoxy resin ("EPOTOHTO PP-101" by Tohto Kasei Co., Ltd.) were added to react it under a nitrogen atmosphere at a temperature of 250° C. for a period of 2 hours, so as to obtain a rosin ester "A" having an acid value of 0.3 and a softening point of 104° C.

Synthesize Example 2

The same process was carried out except using hydrogenerated rosin pentaerythritol ester having an acid value of 4.6 and a softening point of 98° C. ("PINECRYSTAL KE-311" by Arakawa Chemical Industries Co. Ltd.), instead of hydrogenerated rosin glycerin ester having an acid value of 4.8 and a softening point of 101° C. ("PINECRYSTAL KE-100" by Arakawa Chemical Industries Co. Ltd.) used in Synthesize Example 1, so as to obtain a rosin ester "B" having an acid value of 0.5 and a softening point of 100° C.

Example 1

A polymerizable monomer for core comprising 80.5 parts of styrene, 19.5 parts of n-butyl acrylate, 0.5 parts of divinylbenzene, and 0.3 parts of a macro monomer of polymethacrylic acid ester ("AA6" by Toagosei Co., Ltd.); 7 parts of carbon black ("#25B" by Mitsubishi Chemical Corporation); 1 part of a charge control resin (FCA-626-NS by Fujikura Kasei Co., and a glass transition temperature of 60° C.), 10 parts of dipentaerythritol hexamyristate, 1.2 parts of t-dodecyl mercaptan, and 20 parts of the rosin ester "A" obtained by Synthesize Example 1 were dispersed by means of a beads mill, so as to obtain a polymerizable monomer composition for core.

On the other hand, 10.2 parts of magnesium chloride were dissolved into 250 parts of ion exchanged water to obtain a solution, into which another solution of 6.2 parts of sodium hydroxide dissolved in 50 parts of ion exchanged water was gradually added with stirring, so as to obtain a colloid dispersion solution of magnesium hydroxide. Measurement of the particle size distribution of the formed colloid was made by using an SALD particle size distribution meter (manufactured by Shimadzu Corporation), showing that when being measured from the smaller particle size, a 50% cumulative value of number particle size distribution (Dp50) of 0.35 μm, and a 90% cumulative value of number particle size distribution of 0.62 μm.

Also, 2 parts of methylmethacrylate and 65 parts of water were subjected to minute dispersion treatment by means of a supersonic emulsifier, so as to obtain a water-dispersion solution of polymerizavle monomer for the shell. The liquid drop of the polymerizavle monomer for shell has a Dp90 of 1.6 μm Into the colloid dispersion solution of magnesium hydroxide as obtained above, the polymerizable monomer composition for core was added and stirred until the liquid drops ware stabilized, and then, 5 parts of t-butylperoxy-2-ethylhexanoate ("PERBUTYL O", manufactured by NOF Corporation) was added. Then, the dispersion solution was passed through an EBARA MILDER ("MDN 303V MODEL" manufactured by Ebara Corporation) rotating at 15,000 rpm, while circulating the dispersion solution with turning back it into the original stirring bath at a discharge speed of 0.5 m/s. The dispersion solution was passed through the EBARA MILDER for the total holding time of 3 seconds. The tip of the inner nozzle was adjusted to place it 50 mm below the level of the dispersion solution in the stirring bath. Thereby, liquid droplets were formed by 10 circulations. The EBARA MILDER was provided with a cooling jacket therearound, and cooling water at a temperature of 15° C., approximately, was passed through.

Into the colloid dispersion solution forming liquid droplets of magnesium hydroxide having the monomer composition for core, 1 part of sodium tetraborate decahydrate was added to put them into a reactor with a stirrer, to initiate polymerization reaction at a temperature of 85° C. After reaching a polymerization inversion rate of, approximately, 100%, 0.3 parts of water-soluble initiator ("VA-086" being 2,2'-azobis (2-methyl-N-(2-hydroxyethyl) propionamido) made by Wako Pure Chemical Industries, Ltd.) was dissolved in the polymerizable monomer for the shell, followed by being added into the reactor. After continuing polymerization for 4 hours, the reaction was terminated to obtain an aqueous dispersion liquid of the colored particle of the core-shell structure.

With stirring the aqueous dispersion solution of the colored particle as obtained above, sulfuric acid was added until pH reached 4 or less to subject it to acid washing, followed by separating water by filtration. Then, washing and dewater were repeated several times. The solid content was filtered for separation, followed by drying it at a temperature of 45° C. for 2 days, so as to obtain a colored particle of the core-shell structure having a volume average particle size (dv) of 9.8 μm, a particle size distribution (dv/dp) of 1.14 and an average sphericity of 1.12.

Into 100 parts of the colored particle of the core-shell structure as obtained above, 1 part of silica as external additive ("AEROSIL R104," made by Nippon Aerosil Co., Ltd.) was added, followed by mixing them for a period of 10 minutes at a rotation speed of 1,400 rpm by using Henschel Mixer, so as to obtain a toner. The properties and evaluation of the image with respect to the obtained toner is shown in table 1.

Example 2

A colored particle and a toner as Example 2 were prepared in the same manner of Example 1, except using rosin ester "B" instead of using rosin ester "A" used in Example 1. The properties and evaluation of the image with respect to the obtained toner is shown in table 1.

Comparative Example 1

A colored particle and a toner as Comparative Example 1 were prepared in the same manner of Example 1, except using a hydrogenerated rosin glycerin ester as rosin ester C ("PINECRYSTAL KE-100," made by Arakawa Chemical Industries Co., Ltd.), having an acid value of 4.8 and a softening point of 101° C., instead of using rosin ester "A" used in Example 1. The properties and evaluation of the image with respect to the obtained toner is shown in table 1.

Comparative Example 2

A colored particle and a toner as Comparative Example 2 were prepared in the same manner of Example 1, except using a hydrogenerated petroleum oil resin ("ARKON P-100" made by Arakawa Chemical Industries Co., Ltd.), having an acid value of 0 and a softening point of 101° C., instead of rosin ester "A" used in Example 1. The properties and evaluation of the image with respect to the obtained toner is shown in Table 1.

TABLE 1

| | Examples | | Comp. Examples | |
|---|---|---|---|---|
| | 1 | 2 | 1 | 2 |
| Rosin Ester A (Acid Value: 0.3) | 20 | | | |
| Rosin Ester B (Acid Value: 0.5) | | 20 | | |
| Rosin Ester C (Acid Value: 4.8) | | | 20 | |

TABLE 1-continued

| | Examples | | Comp. Examples | |
|---|---|---|---|---|
| | 1 | 2 | 1 | 2 |
| Hydrogenerated Petroleum Oil Resin (Acid Value: 0) | | | | 20 |
| Property of the Colored particle | | | | |
| Dv (μm) | 9.8 | 9.6 | 12.1 | 9.9 |
| Dv/dp | 1.14 | 1.13 | 1.39 | 1.14 |
| Property of the Toner | | | | |
| Volume resistivity (log(Ω · cm)) | 11.3 | 11.2 | 11.2 | 11.3 |
| Flowability | 78 | 80 | 45 | 80 |
| Shelf stability (%) | <1 | <1 | 40 | <1 |
| Evaluation of the image | | | | |
| Fixing temperature (° C.) | 135 | 135 | 135 | 145 |
| Circumstance Stability (H/H) | >10,000 | >10,000 | 3,000 | >10,000 |
| (L/L) | >10,000 | >10,000 | >10,000 | >10,000 |
| Durability | >20,000 | >20,000 | 15,000 | >20,000 |

The result of the evaluations in Table 1 leads the following consideration.

The toner as Comparative Example 1, wherein the rosin ester was used whose acid value was larger than the range defined in the present invention, is inferior, particular, in flowability and shelf stability, circumstance stabilization property in an H/H circumstance, and durability.

The toner as Comparative Example 2, using hydrogenerated petroleum oil resin, is found to have a fixing temperature higher than the toner of the present invention.

Contrary to Comparative Examples, the toners as Examples 1 and 2 in accordance with the present invention have found to have an excellent balance in fixing temperature and shelf stability. The toners of the present invention also have found to have a good flowability. In addition, the quality of the image has been kept stable even under various circumstances.

According to the present invention, there is provided a toner for developing an electrostatic image, having a good shelf stability and fixing property. The toner of the present invention is found to have a good transferred property without decreasing a printing concentration nor generating a fog, even when it is durably printed under various circumstances and for an extended period.

What is claimed is:

1. A toner for developing an electrostatic image comprising:

a colored particle comprising a binder resin, a colorant, a charge control agent and a rosin ester having an acid value of 2 or less, wherein the colored particle is prepared by subjecting a polymerizable monomer composition containing a polymerizable monomer, a colorant, a charge control agent and a rosin ester having an acid value of 2 or less to polymerization in an aqueous dispersion medium including a dispersion stabilizer, said colored particle has an average sphericity of 1 to 1.3; and an external additive, and further wherein the rosin ester is an esterification compound of a rosin compound with a polyalcohol, wherein the esterification compound is reacted with an epoxy compound.

2. A toner for developing an electrostatic image comprising:

a colored particle having a core and a shell covering the core, wherein the core comprises a binder resin, a colorant, a charge control agent and a rosin ester having an acid value of 2 or less, and an external additives, and further wherein the shell is formed of a polymer prepared by subjecting a polymerizable monomer that forms a polymer having a glass transition temperature exceeding of 80° C. to polymerization.

3. A toner for developing an electrostatic image according to claim 2, wherein the rosin ester is an esterification compound of a rosin compound with a polyalcohol.

4. A toner for developing an electrostatic image according to claim 3, wherein the rosin compound is selected from the group consisting of gum rosin, wood rosin and tall oil rosin, and denaturations thereof by subjecting to disproportion, hydrogenation, partial fumarization, partial maleinization and polymerization.

5. A toner for developing an electrostatic image according to claim 3, wherein the polyalcohol is selected from the group of pentaerythritol, glycerin and diethyleneglycol.

6. A toner for developing an electrostatic image comprising:

a colored particle having a core and a shell covering the core, wherein the core includes a rosin ester having an acid value of 2 or less, and an external additive, and further wherein the rosin ester is an esterification compound of a rosin compound with a polyalcohol, wherein the esterification compound is reacted with an epoxy compound.

7. A toner for developing an electrostatic image according to claim 6, wherein the epoxy compound is selected from the group consisting of bisphenol A epoxy resin, bisphenol F epoxy resin, phenol novolak epoxy resin, and alcohol glycidyl ether epoxy resin.

8. A toner for developing an electrostatic image comprising:

a colored particle comprising:

a binder resin, a colorant, a charge control agent, and a rosin ester having an acid value of 2 or less, wherein the rosin ester is an esterification compound of a rosin compound with an polyalcohol, wherein the esterification compound is reacted with an epoxy compound, and wherein the rosin ester is included in an amount of 5 to 50 parts by weight per 100 parts by weight of the binder resin; and an external additive.

9. A toner for developing an electrostatic image according to claim 8, wherein the colored particle has a core and a shell covering the core, wherein the core includes the rosin ester.

10. A toner for developing an electrostatic image according to claim 9, wherein the core of the colored particle further comprises at least one selected from the group consisting of a binder resin, a colorant, a charge control agent, and a parting agent.

11. A toner for developing an electrostatic image according to claim 8, wherein the colorant is selected from the group consisting of carbon black, titanium black, magnetic powder, oil black and titanium white, and any pigments and/or dyes.

12. A toner for developing an electrostatic image according to claim 8, wherein the rosin compound is selected from the group consisting of gum rosin, wood rosin and tall oil rosin, and denaturations thereof by subjecting to disproportion, hydrogenation, partial fumarization, partial maleinization and polymerization.

13. A toner for developing an electrostatic image according to claim 8, wherein the polyalcohol is selected from the group of pentaerythritol, glycerin and diethyleneglycol.

14. A toner for developing an electrostatic image according to claim 8, wherein the epoxy compound is selected from the group consisting of bisphenol A epoxy resin, bisphenol F epoxy resin, phenol novolak epoxy resin, and alcohol glycidyl ether epoxy resin.

15. A toner for developing an electrostatic image according to claim 8, wherein the colored particle has a volume average particle size (dv) of 2 to 2 μm.

16. A toner for developing an electrostatic image according to claim 8, wherein the colored particle has a particle size distribution (dv/dp) of 1.0 to 1.3.

17. A toner for developing an electrostatic image according to claim 8, wherein the colored particle has an average sphericity of 1 to 1.3.

* * * * *